US007281298B2

(12) United States Patent
Joung et al.

(10) Patent No.: US 7,281,298 B2
(45) Date of Patent: Oct. 16, 2007

(54) UPRIGHT VACUUM CLEANER WITH FOLDABLE HANDLE

(75) Inventors: Myoung-sun Joung, Gwangju (KR); Byung-jo Lee, Gwangju (KR); Joo-sung Moon, Seoul (KR); Dae-yeoun Moon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 560 days.

(21) Appl. No.: 10/946,600

(22) Filed: Sep. 21, 2004

(65) Prior Publication Data

US 2005/0210626 A1 Sep. 29, 2005

(30) Foreign Application Priority Data

Mar. 24, 2004 (KR) ..... 10-2004-0019856

(51) Int. Cl.
*A47L 9/32* (2006.01)

(52) U.S. Cl. ..... 15/410; 15/350

(58) Field of Classification Search ... 15/410; *A47L 9/32*

See application file for complete search history.

(56) References Cited

U.S. PATENT DOCUMENTS

| | | | | |
|---|---|---|---|---|
| 1,677,721 | A * | 7/1928 | Lindgren | 15/410 |
| 1,787,696 | A * | 1/1931 | McLaren | 15/410 |
| 3,204,272 | A * | 9/1965 | Greene et al. | 15/410 |
| 3,758,914 | A * | 9/1973 | Nupp et al. | 15/410 |
| 4,662,026 | A * | 5/1987 | Sumerau et al. | 15/410 |
| 6,012,200 | A * | 1/2000 | Murphy et al. | 15/410 |
| 6,779,229 | B2 * | 8/2004 | Lee et al. | 15/410 |
| 6,941,615 | B2 * | 9/2005 | Shanor et al. | 15/410 |
| 7,159,271 | B2 * | 1/2007 | Sepke et al. | 15/410 |

FOREIGN PATENT DOCUMENTS

| | | | |
|---|---|---|---|
| EP | 1033101 A2 | * | 9/2000 |
| JP | 08-173363 | * | 7/1996 |
| JP | 2001-087187 | * | 4/2001 |
| JP | 2001-218709 | | 8/2001 |
| KR | 10-0213651 | | 5/1999 |
| KR | 100389288 | | 3/2002 |

OTHER PUBLICATIONS

Hoover® FoldAway™ Upright Owner's Manual, pp. 1-4, 2003.

* cited by examiner

*Primary Examiner*—Theresa T. Snider
(74) *Attorney, Agent, or Firm*—Ladas & Parry LLP

(57) ABSTRACT

An upright-type vacuum cleaner having an improved, foldable handle structure to reduce the amount of storage space required when the cleaner is not in use. The upright vacuum cleaner is provided with a handle that is hinged at a pivot point to enable the handle to rotate relative to the cleaner body. A locking unit locks and releases the handle in at least one user-desired position.

7 Claims, 5 Drawing Sheets

UPRIGHT VACUUM CLEANER WITH FOLDABLE HANDLE

CROSS-REFERENCE TO RELATED APPLICATIONS

This application claims the benefit of Korean Patent Application No. 2004-19856, filed Mar. 24, 2004, in the Korean Intellectual Property Office, the disclosure of which is incorporated herein by reference.

BACKGROUND OF THE INVENTION

1. Field of the Invention

The present invention relates generally to a vacuum cleaner and, more particularly, to an upright-type vacuum cleaner which has a foldable handle to reduce the amount of space needed for storage when the cleaner is not in use.

2. Description of the Background Art

General upright-type vacuum cleaners comprise a cleaner body having a vacuum generator and a dust collecting apparatus, a suction nozzle for collecting dust lying on a surface being cleaned, and a handle for a user to grip the cleaner body. The handle, provided for carriage of the cleaner body, may be further equipped with a controlling panel so as to be more convenient use.

However, since the upright-type vacuum cleaner is usually stowed in an upright manner, the handle protrudes to extend upwardly from the cleaner body. Therefore, it becomes possible for the handle to be broken or damaged by impact while the vacuum cleaner is in storage. Further, when the vacuum cleaner is not in use, excessive space is required due to the handle that extends obliquely away from the vacuum cleaner.

SUMMARY OF THE INVENTION

An aspect of the present invention is to solve at least the above-mentioned problems and/or disadvantages and to provide at least the advantages described below. Accordingly, an aspect of the present invention is to provide an upright-type vacuum cleaner having an improved handle to reduce the required storage space and to prevent damage of the handle when the cleaner is not in use.

In order to achieve the above-described aspects of the present invention, there is provided an upright-type vacuum cleaner comprising a cleaner body, a handle hinged at a pivot point enabling the handle to rotate relative to the cleaner body, and a locking unit for fixing the handle at a desired position.

The cleaner body preferably comprises a handle receiving recess, in which the handle is received when it has been folded over, as described below.

The locking unit fixes the handle in either the extended or folded positions, respectively. The locking unit may be disposed on a hinge shaft for connecting the handle to the cleaner body.

The locking unit preferably comprises a locking mechanism, a holder for selectively receiving the locking mechanism and the guiding hinge movement of the handle, and at least one release button disposed adjacent the holder to depress the holder. Preferably, two release buttons are disposed opposite each other relative to the holder.

The holder comprises a locking groove corresponding to the locking mechanism such that the handle can selectively rotate about the hinge on the cleaner body.

The locking mechanism comprises a locking body, a guide boss formed in the center of the locking body, and a plurality of locking projections formed around the guide boss to extend into and retract from apertures in the handle.

The guide boss includes a resilient member disposed to contact the guide boss so that the locker body is resiliently supported thereby and is biased toward one inner side of the handle.

The holder comprises a locking groove corresponding to each locking projection so as to selectively receive the handle in the cleaner body.

The release button is disposed in a space formed between the holder and the cleaner body and is configured to depress the locking mechanism.

BRIEF DESCRIPTION OF THE DRAWING FIGURES

The above aspect and other features of the present invention will become more apparent by achieving an understanding of the following detailed description of the exemplary embodiments thereof with reference to the attached drawing figures, wherein.

DETAILED DESCRIPTION OF THE PREFERRED EMBODIMENTS

Figure 1:
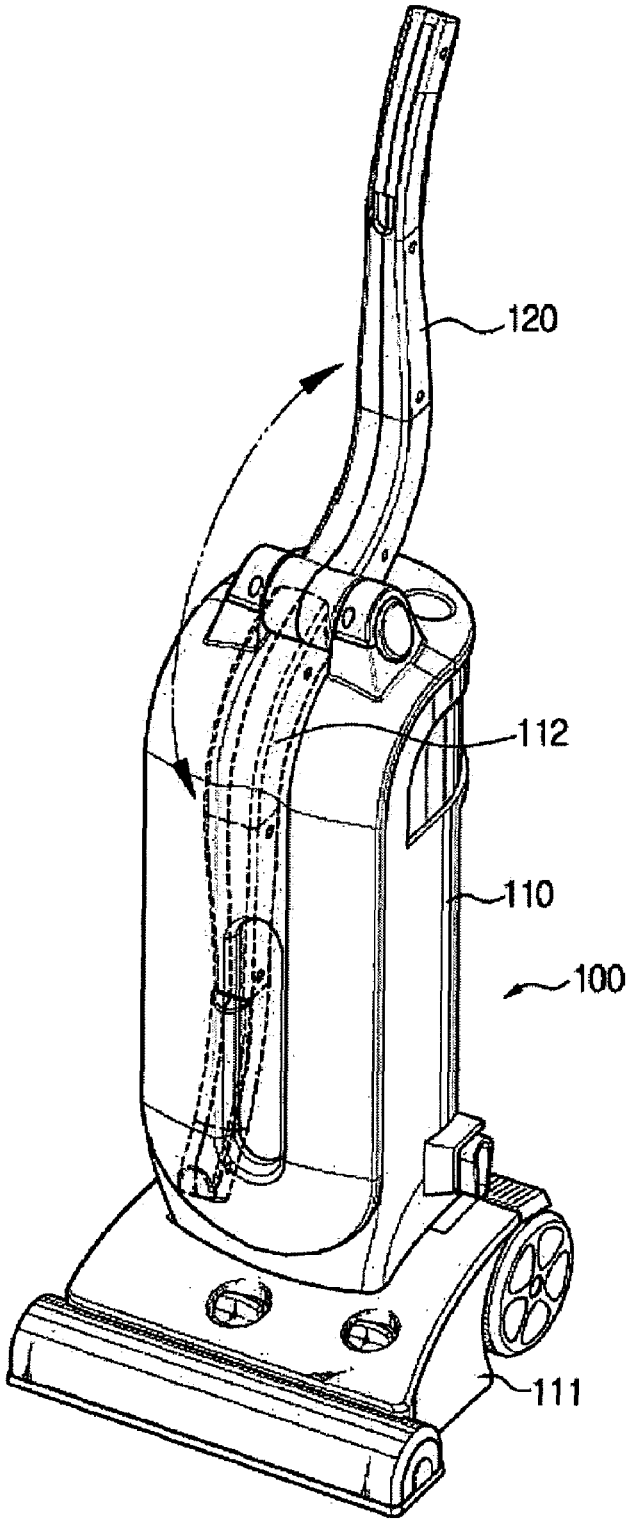
FIG. 1 is a perspective view of an upright-type vacuum cleaner having a foldable handle according to an embodiment of the present invention.

Hereinafter, an embodiment of the present invention will be described in detail with reference to the accompanying drawing figures.

In the following description, identical drawing reference numerals indicate the same or similar elements between the views of the different drawings. The matters set forth in the description below, such as the detailed construction, elements and method of operation, are exemplary only and are provided only to assist in a comprehensive understanding of the invention. Thus, it is apparent to those having ordinary skill that the present invention can be carried out without use of or reference to these exemplary specified embodiments. Also, well-known functions or constructions are not described in detail, since they would obscure the invention in unnecessary detail.

FIG. 1 is a perspective view of an upright-type vacuum cleaner having a foldable handle according to an embodiment of the present invention. The upright-type vacuum cleaner 100 comprises a cleaner body 110 including a suction nozzle 111 for drawing in dust from a surface being cleaned, the suction nozzle 111 being hingedly connected to one end of the cleaner body 110, and a handle 120, hingedly connected to the opposite end of the cleaner body 110.

Due to the hinge structure between the cleaner body 110 and the suction nozzle 111, although a user grasps the handle 120 and inclines the cleaner body 110 toward the user's body, the suction nozzle 111 maintains close contact with the surface being cleaned. Therefore, the user can operate the cleaner in a more comfortable posture by utilizing the cleaner body 110 at a certain inclination to the vertical.

In addition, a handle receiving recess 112 is formed on a front of the cleaner body 110 to minimize the portion of the handle 120 that protrudes when the handle is folded down into the cleaner body 110. The handle receiving recess 112 has a shape corresponding to the handle 120 such that the handle 120 is received into the handle receiving recess 112.

The handle 120 is hingedly mounted to the cleaner body 110, and a hinge shaft is provided in the cleaner body, which comprises a locking unit 200 (FIG. 2) to fix the position of the handle 120 in both an extended position and in a folded position.

Figure 2:
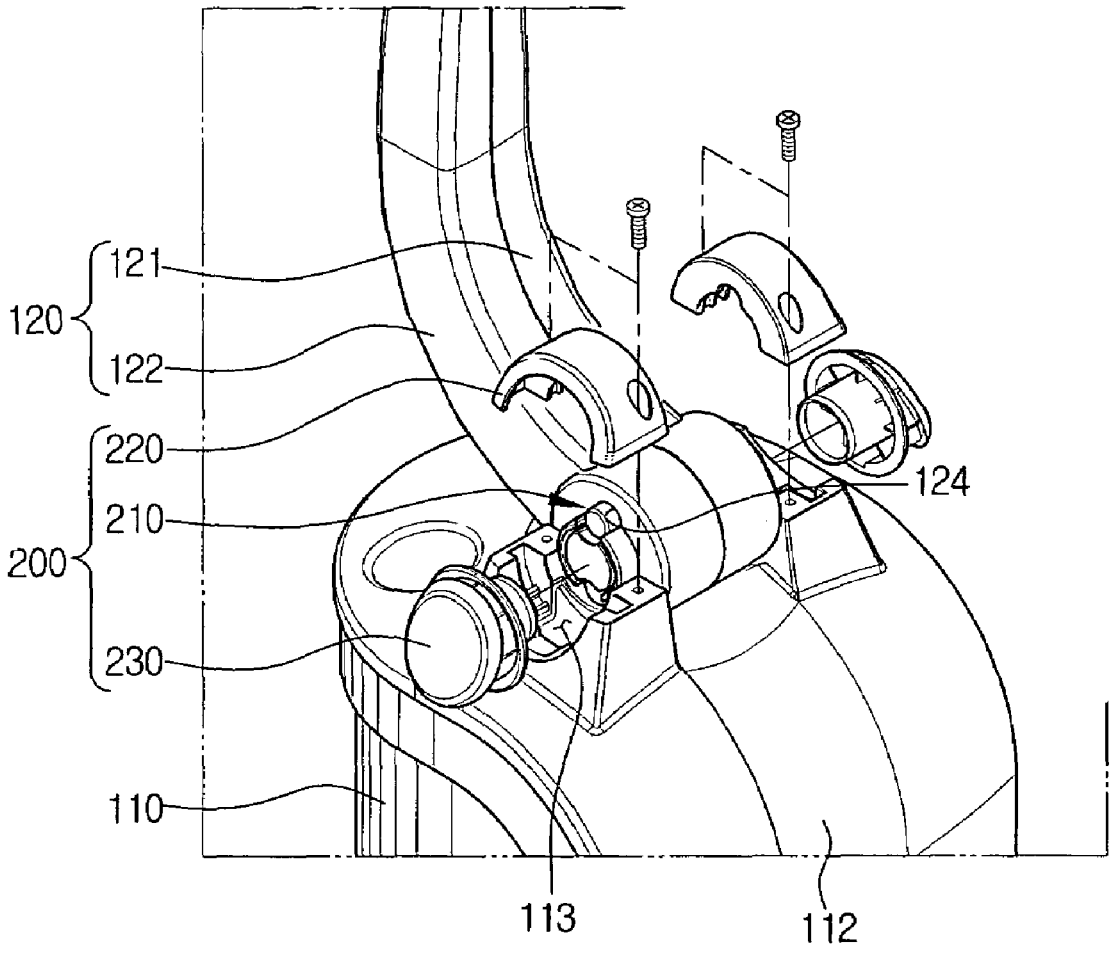
FIG. 2 is a perspective, enlarged detail view of the connection of the foldable handle shown in FIG. 1.
Figure 3:
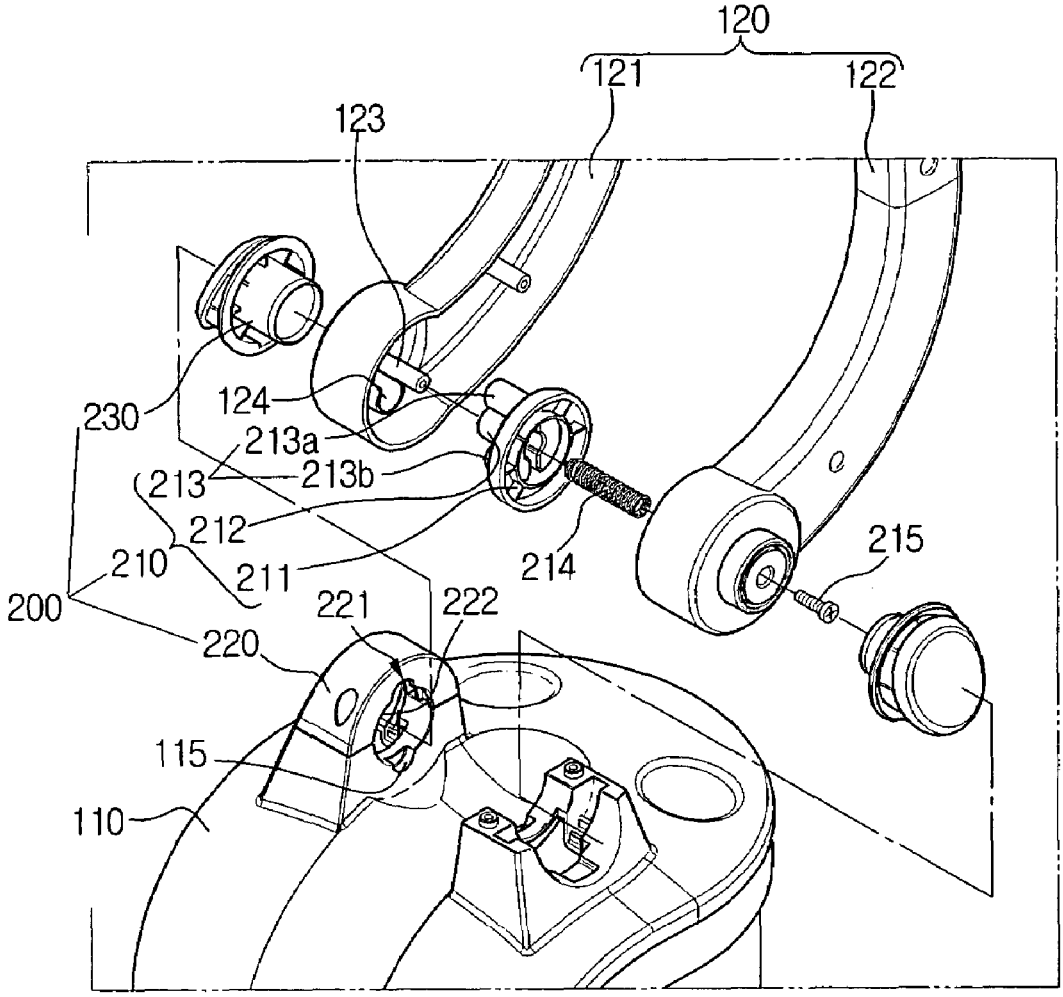
FIG. 3 is an exploded, perspective detail view of the foldable handle according to an embodiment of the present invention.

According to an embodiment of the present invention, the handle 120 is constructed by first and second handle housings 121 and 122, as shown in FIGS. 2 and 3. The first and second handle housings 121 and 122 enclose a locking mechanism 210, which will be described below, and a resilient member 214. The first and second handle housings 121 and 122 are fastened to each other by a bolt 215, as shown in FIG. 3.

The locking unit 200 comprises the locking mechanism 210, a holder 220 and a release button 230.

The locking mechanism 210, as shown in FIG. 3, is mounted within the handle 120 so as to be resiliently inserted into and out of the handle 120. The locking mechanism 210 comprises a locking body 211, a guide boss 212 and a locking projection 213.

The locking body 211 is formed so as to engage the first and second handle housings 121 and 122, and preferably, is formed as a disc having a center aligned with an inner boss 123 of the handle housings 121 and 122. The locking body 211, the guide boss 212 and the locking projection 213 may be integrally formed, for example, by molding or other appropriate manufacturing process.

The guide boss 212, disposed substantially adjacent the center of the locking body 211, is coupled with the inner boss 123, which defines the hinge shaft of the handle 120. The guide boss 212 guides the movement of the locking body 211 while sliding along an axis of the inner boss 123 within the handle 120. Furthermore, the guide boss 212 comprises therein the resilient member 214, of which one end is supported by an inner surface of the second housing 122. The resilient member 214 resiliently supports the locking body 211 and biases it in a direction away from the second housing 122.

A plurality of locking projections 213 is disposed around the guide boss 212, and the locking projections are formed to be able to protrude out of a perforate aperture or hole 124. According to an embodiment of the present invention, a pair of the locking projections 213*a* and 213*b* is positioned to be oppositely disposed with respect to the guide boss 212, as shown in FIG. 3. However, this is only a preferred embodiment, and the number of the locking projection 213 is not limited to the two shown. For example, several locking projections 213 may be provided symmetrically with respect to the guide boss 212.

The holder 220 is attached to an upper part of the cleaner body 110 to prevent separation of the handle 120 therefrom. A first locking groove 221 is formed on an inner circumference 222 of the holder 220 to receive the first locking projection 213*a*. On the upper part of the cleaner body 110, a second locking groove 115 is formed, oppositely disposed relative to the first locking groove 221, to receive the second locking projection 213*b*. When the handle 120 is folded down into the cleaner body 110, the second locking groove 115 receives the first locking projection 213*a*, which has been received in the first locking groove 221. It should be noted that although the locking grooves 115 and 123 are described in the singular, a second set of grooves is preferably disposed on the other holder, essentially duplicating the above-described structure.

The release button 230 is provided for releasing the locking mechanism from the locked position of the handle 120 when a user wants to fold the handle 120 down over and into the cleaner body 110 for storage of the upright-type vacuum cleaner 100, or to extend the handle 120 for use of the upright-type vacuum cleaner 100. As shown in FIG. 2, the release button 230 is mounted in a space 113 defined when the cleaner body 100 and the holder 220 are connected, and is designed to be resiliently pressed. If the release button 230 is pushed in the direction of the arrow shown in FIG. 4, the first and the second locking projections 213*a* and 213*b* are depressed to a position inside of the handle 120, thereby releasing the locking projections from engagement with the first and the second locking grooves 115 and 221. Accordingly, the handle 120 is released from the fixed position retaining the handle either in the upright or folded position. When the first and the second locking projections 213*a* and 213*b* engage the first and second locking grooves 115 and 221, while being rotated, the first and the second locking projections 213*a* and 213*b* are received in the first and second locking grooves 115 and 221 and are retained therein by the resilient recovering force of the resilient member 214.

Figure 4:
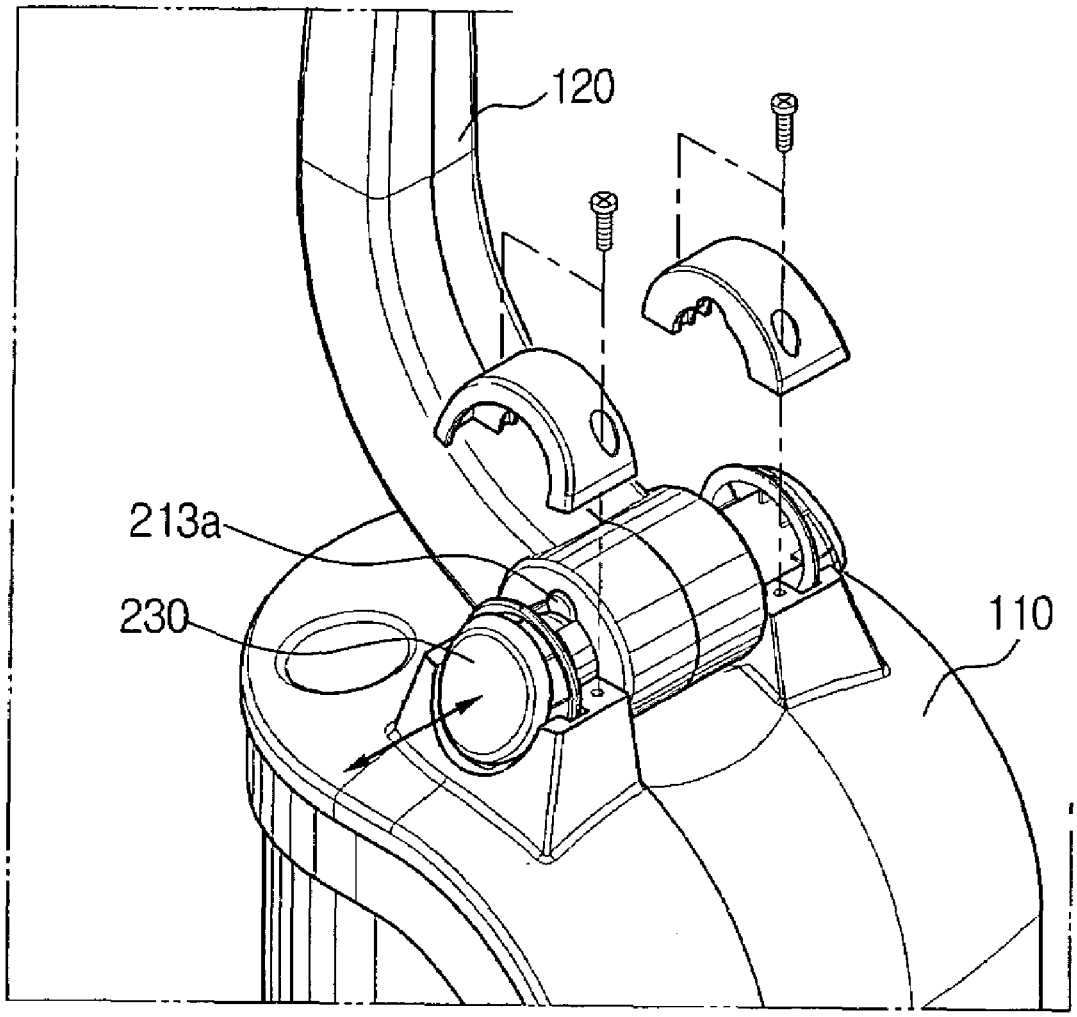
FIGS. 4 and 5 are perspective views illustrating the operation of a locking unit, in the different positions in which the handle is upright and folded down, respectively, in an upright-type vacuum cleaner according to an embodiment of the present invention.

Hereinbelow, the operation of the upright-type vacuum cleaner 100 having the foldable handle 120 according to an embodiment of the present invention will be described with reference to FIGS. 4 and 5.

As shown in FIG. 1, in which view the handle 120 is shown to be extended in the upright position, the user depresses the release button 230 mounted in the space 113 (FIG. 2) between the cleaner body 110 and the holder 220 in order to initiate the operation to fold the handle 120 down toward the cleaner body 110.

Accordingly, the release button 230 depresses the first and the second locking projections 213*a* and 213*b* (FIG. 3), thereby releasing them from the first and second locking grooves 115 and 221. The first locking projection 213*a*, being released from the first locking groove 221, slides along the inner circumference 222 (FIG. 3) of the holder 220 in association with the turning of the handle 120, to reach the second locking groove 115. The second locking projection 213*b* slides in the same manner along the inner circumference formed by the upper portion of cleaner body 110 and the holder 220, similar to that of the first locking projection 213*a*, until it reaches the first locking groove 221.

Figure 5:
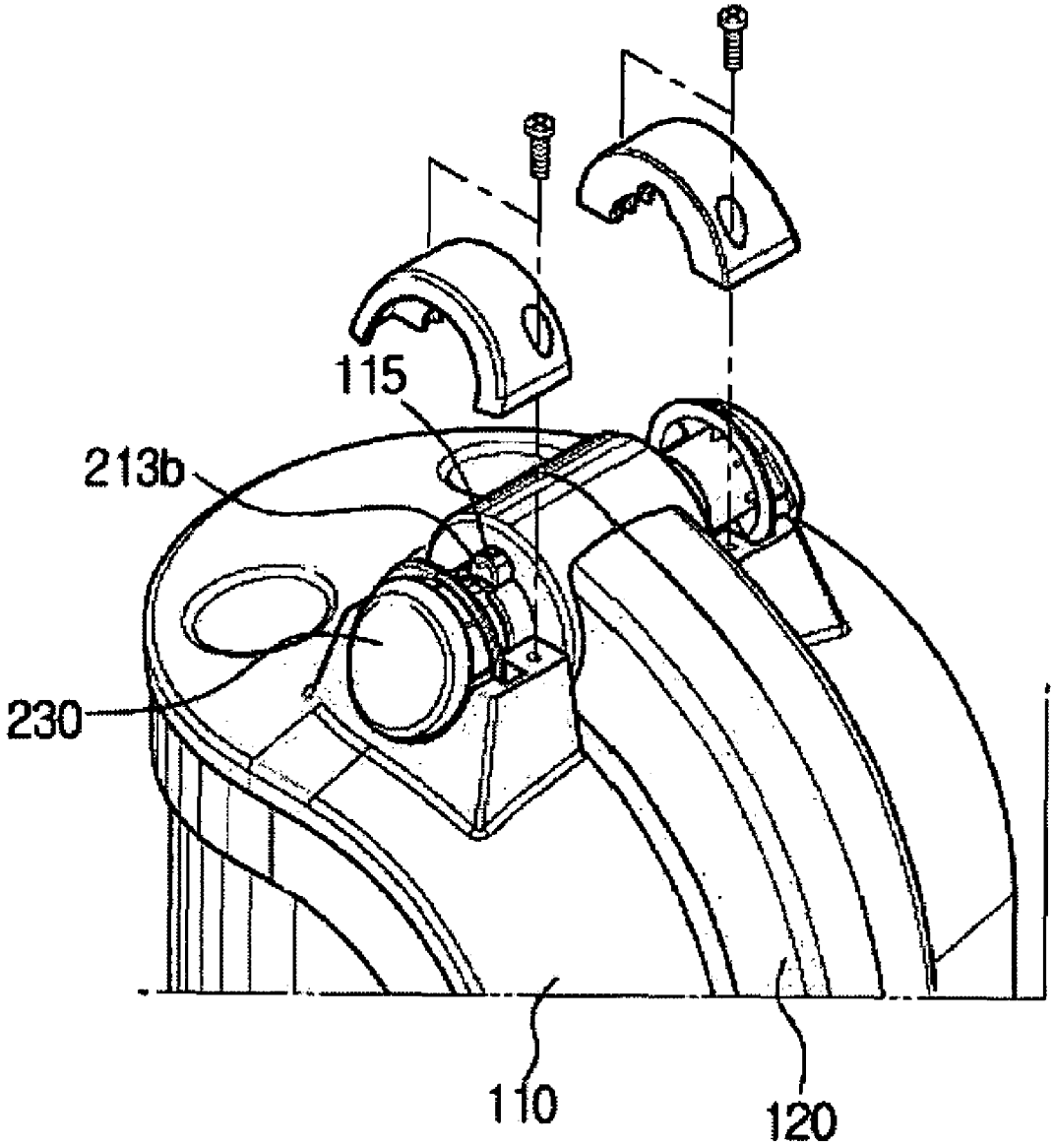

As shown in FIG. 5, when the first locking projection 213*a* reaches the second locking groove 115, the first locking projection 213*a* is caused to protrude out of the handle 120 by the resilient recovering force of the resilient member 214, thereby being received and fixed in the second locking groove 115.

As shown in FIG. 5, when the handle 120 is extended to the upright position, the second locking projection 213*b* is received in the second locking groove 115, whereas when the handle 120 is folded down, the second locking projection 213*b* is received in the first locking groove 221 (FIG. 2). Accordingly, the handle 120 can be fixed in the desired position, both when the handle is folded or extended, and is retained by the first and second locking projections 213*a* and 213*b*. Therefore, the user can operate and stow the upright-type vacuum cleaner 100 with the handle in the desired folded position, and the handle will remain in that position as needed.

As can be appreciated from the above description of the upright-type vacuum cleaner 100, by use of the foldable handle 120, the amount of space necessary for stowage of the vacuum cleaner 100 is reduced, and damage of the handle 120 can be prevented when the vacuum cleaner 100 is stored.

While the invention has been shown and described with reference to certain embodiments thereof, it will be understood by those skilled in the art that various changes in form and details may be made therein without departing from the spirit and scope of the invention as defined by the appended claims.

What is claimed is:

1. An upright-type vacuum cleaner comprising:

a cleaner body;

a handle hinged at a pivot point enabling the handle to rotate relative to the cleaner body; and a locking unit which fixes the handle in, at least, extended and folded positions, the locking unit being disposed on a hinge shaft connecting the handle to the cleaner body, the locking unit comprising:

a locking mechanism, resiliently mounted in the handle to extend into and retract from a hole in the handle, a holder for selectively receiving the locking mechanism and guiding hinge movement of the handle; and at least one release button disposed adjacent the holder to depress the holder.

2. The upright-type vacuum cleaner of claim 1, wherein the cleaner body comprises a handle receiving recess in which the handle is received when it has been rotated downwardly such that the handle can be received into the handle receiving recess.

3. The upright-type vacuum cleaner of claim 1, wherein the locking mechanism further comprises:

a locking body;

a guide boss formed in the center of the locking body; and a plurality of locking projections formed around the guide boss to extend into and retract from apertures in the handle.

4. The upright-type vacuum cleaner of claim 3, wherein the guide boss includes a resilient member disposed to contact the guide boss.

5. The upright-type vacuum cleaner of claim 3, wherein the holder comprises a locking groove corresponding to each locking projection.

6. The upright-type vacuum cleaner of claim 1, wherein the release button is disposed in a space formed between the holder and the cleaner body and is configured to depress the looking mechanism.

7. The upright-type vacuum cleaner of claim 1, wherein the locking unit further comprises plural release buttons disposed adjacent opposite sides of the holder to depress the holder.

* * * * *